US012302996B2

(12) United States Patent
Houng et al.

(10) Patent No.: US 12,302,996 B2
(45) Date of Patent: May 20, 2025

(54) LACE GUIDE FOR ARTICLES OF FOOTWEAR

(71) Applicant: NIKE, Inc., Beaverton, OR (US)

(72) Inventors: Derek Houng, Portland, OR (US); Benjamin Nethongkome, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 237 days.

(21) Appl. No.: 17/477,367

(22) Filed: Sep. 16, 2021

(65) Prior Publication Data

US 2022/0079293 A1 Mar. 17, 2022

Related U.S. Application Data

(60) Provisional application No. 63/079,818, filed on Sep. 17, 2020.

(51) Int. Cl.
*A43B 23/02* (2006.01)
*A43C 1/04* (2006.01)
(Continued)

(52) U.S. Cl.
CPC ..... *A43C 5/00* (2013.01); *A43B 23/0245* (2013.01); *A43C 1/04* (2013.01); *A43C 7/00* (2013.01)

(58) Field of Classification Search
CPC .... A43C 5/00; A43C 1/04; A43C 7/00; A43B 23/0245
See application file for complete search history.

(56) References Cited

U.S. PATENT DOCUMENTS 697,344 A * 4/1902 Leland ..... A43C 5/00 24/713.6
2,539,761 A * 1/1951 Whitman ..... A43C 1/00 36/114
(Continued)

FOREIGN PATENT DOCUMENTS

CN 201005126 Y 1/2008
CN 106 174 878 B 1/2019
(Continued)

OTHER PUBLICATIONS

"The Barn: Glossary of Shoe Terms," accessed at *Glossary of Shoe Terms* (thebarnshoes.com) on Sep. 16, 2021.
(Continued)

*Primary Examiner* — Katharine G Kane
(74) *Attorney, Agent, or Firm* — Klarquist Sparkman, LLP

(57) ABSTRACT

This disclosure is directed to lace-receiving structures that may be included in articles of footwear. More specifically, in some embodiments, the articles of footwear disclosed herein include a sole structure, an upper coupled to the sole structure and forming a foot-receiving cavity therebetween, and a lace-receiving structure that extends through the upper into the foot-receiving cavity and is configured to receive an adjustment member. In some embodiments, the upper includes an aperture that is configured to permit the lace-receiving structure to extend through the upper. In some embodiments, the lace-receiving structure may include an anchor portion that extends underneath an interior surface of the upper within the foot-receiving cavity. The anchor portion may be configured to couple the lace-receiving structure to the upper.

19 Claims, 9 Drawing Sheets

(51) Int. Cl.
*A43C 5/00* (2006.01)
*A43C 7/00* (2006.01)

(56) References Cited

U.S. PATENT DOCUMENTS

| | | | | |
|---|---|---|---|---|
| 4,811,500 | A * | 3/1989 | Maccano | A43B 5/00 36/91 |
| 5,377,430 | A | 1/1995 | Hatfield et al. | |
| 5,471,769 | A | 12/1995 | Sink | |
| 5,692,320 | A | 12/1997 | Nichols | |
| D410,691 | S | 6/1999 | Boyer | |
| 5,992,057 | A * | 11/1999 | Monti | A43B 7/1495 36/89 |
| 7,343,701 | B2 * | 3/2008 | Pare | A43C 1/06 36/88 |
| 8,806,776 | B2 | 8/2014 | Leick et al. | |
| 10,316,441 | B2 | 6/2019 | Ly | |
| 10,362,832 | B2 | 7/2019 | Bell et al. | |
| 11,375,774 | B2 | 7/2022 | Durrell et al. | |
| 2002/0166260 | A1 * | 11/2002 | Borsoi | A43B 5/0401 36/50.1 |
| 2004/0181972 | A1 | 9/2004 | Csorba | |
| 2005/0284001 | A1 | 12/2005 | Hoffman et al. | |
| 2016/0058099 | A1 | 3/2016 | Panian et al. | |
| 2016/0302524 | A1 * | 10/2016 | Smith | A43B 13/12 |
| 2017/0208900 | A1 | 7/2017 | Boucher et al. | |
| 2017/0354204 | A1 * | 12/2017 | Giacobone | A43B 5/06 |
| 2019/0307209 | A1 * | 10/2019 | Houng | A43C 11/22 |
| 2020/0100560 | A1 * | 4/2020 | Garcia | A43B 13/04 |
| 2020/0329819 | A1 * | 10/2020 | Durand | A43B 1/04 |

FOREIGN PATENT DOCUMENTS

| | | | |
|---|---|---|---|
| DE | 19710702 | A1 | 9/1998 |
| GB | 207426 | A | 11/1993 |
| JP | 54132446 | U1 | 9/1979 |
| TW | 299587 | U | 3/1997 |
| TW | M599573 | U | 8/2020 |
| WO | WO 2004/110197 | A2 | 12/2004 |
| WO | WO 2013/019934 | A1 | 2/2013 |
| WO | WO2013/054028 | A1 | 4/2013 |

OTHER PUBLICATIONS

International Search Report and Written Opinion, mailed Jan. 5, 2022, issued for International Patent Application No. PCT/US2021/050512, 14 pages.

* cited by examiner

LACE GUIDE FOR ARTICLES OF FOOTWEAR

CROSS-REFERENCE TO RELATED APPLICATION

This application claims priority to U.S. Provisional Patent Application No. 63/079,818, filed Sep. 17, 2020, which is incorporated by reference herein.

FIELD

This disclosure relates generally to articles of footwear and more particularly to lace-receiving structures for articles of footwear.

BACKGROUND

An article of footwear (also referred to herein as "the article" or "the footwear") typically includes two main components: a sole structure and an upper. The sole structure is configured for supporting the wearer's foot and providing cushioning between the wearer's foot and the ground. The upper is coupled to the sole structure and is configured for securing the wearer's foot to the sole structure.

The article of footwear can also include a closure system. In some examples, a closure system may include one or more guides (also referred to herein as "receiving structures") configured to receive an adjustment member (e.g., a lace, cord, strap, etc.). The adjustment member can be released and/or loosened to allow the wearer to insert their foot into or remove their foot from the article of footwear. The adjustment member can also be tightened and/or fastened to secure the wearer's foot within the article of footwear.

BRIEF DESCRIPTION

Aspects and advantages of the disclosed technology will be set forth in part in the following description, or may be obvious from the description, or may be learned through practice of the technology disclosed in the description.

Disclosed herein are lace-receiving members for articles of footwear that can provide, for example, additional support for lateral movements. Specifically, because the lace-receiving members may extend over the upper and/or because they may be constructed from a stiffer material than the rest of the upper, the lace-receiving members may provide additional support to the upper in areas of the footwear that experience higher stress during lateral movements. As such, the lace-receiving members may limit and/or reduce movement of a wearer's foot relative to the sole structure of the footwear and thus may enhance the wearer's ability to perform quick, explosive lateral movements. That is, the lace-receiving members may hold the wearer's foot more securely in place during lateral movements.

Additionally or alternatively, the disclosed lace-receiving members can, for example, provide an aesthetic element (e.g., design, color, texture, profile, geometry, surface feature, etc.) that can be changed relatively easily (e.g., by a manufacturer, a seller, and/or an end user). In some instances, the lace-receiving members can be fixedly attached to an article of footwear. In other embodiments, the lace-receiving member can be removably coupled to an article of footwear.

In some embodiments, an article of footwear comprises a sole structure, an upper, and a lace-receiving structure. The upper is coupled to the sole structure and forms a foot-receiving cavity therebetween. The upper comprises an aperture configured to receive the lace-receiving structure. The lace-receiving structure extends through the aperture in the upper, underneath the upper, and towards the sole structure.

In other embodiments, an article of footwear comprises a sole structure, an upper, and a lace-receiving structure. The upper is coupled to the sole structure and forms a foot-receiving cavity therebetween. The lace-receiving structure is coupled to the upper and comprises an anchor portion and a main body portion. The anchor portion extends into the foot-receiving cavity underneath the upper. The main body portion extends above the upper, over an exterior surface of the upper.

In yet further embodiments, an article of footwear comprises a sole structure, an upper, a lace-receiving structure, and a reinforcing element. The upper is coupled to the sole structure and forms a foot-receiving cavity therebetween. The upper comprises an aperture configured to receive the lace-receiving structure. The lace-receiving structure extends through the aperture into the foot-receiving cavity and is coupled to the reinforcing element. The reinforcing element is coupled to the upper.

These and other features, aspects, and/or advantages of the present disclosure will become better understood with reference to the following description and the claims. The accompanying drawings, which are incorporated in and constitute a part of this specification, illustrate embodiments of the disclosed technology and, together with the description, explain the principles of the disclosure.

DETAILED DESCRIPTION

General Considerations

Figure 1:
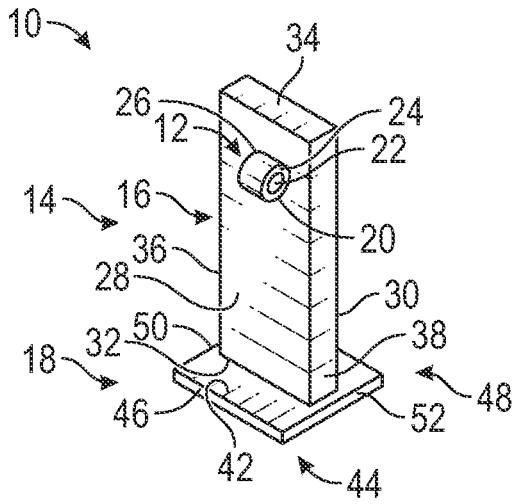
FIG. 1 is a perspective view of an exemplary embodiment of a lace-receiving structure.

The apparatuses and devices described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application, the singular forms "a," "an," and "the" include the plural forms unless the context clearly dictates otherwise. Additionally, the term "includes" means "comprises." Further, the terms "coupled" or "secured" encompass mechanical and chemical couplings, as well as other practical ways of coupling or linking items together, and do not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article from the heel to toe Similarly, a "longitudinal length" refers to a length of the article along the longitudinal axis and a "longitudinal direction" refers to a direction along the longitudinal axis.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the term "upper" refers to any combination of materials that is coupled to the sole structure and is configured to restrict relative movement between a wearer's foot and the sole structure (i.e., to secure the wearer's foot to the sole structure). For example, the upper may be configured to extend over and/or above at least a portion of a wearer's foot (e.g., toes, forefoot, midfoot, etc.) and may form a foot-receiving cavity. The upper may additionally or alternatively be configured to protect the wearer's foot.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "fixedly attached" and "fixedly coupled" refer to two components joined in a manner such that the components may not be readily separated from one another without destroying and/or damaging one or both of the components. Exemplary modalities of fixed attachment may include joining with permanent adhesive, stitches, welding or other thermal bonding, and/or other joining techniques. In addition, two components may be "fixedly attached" or "fixedly coupled" by virtue of being integrally formed, for example, in a molding process.

In contrast, the terms "removably attached" or "removably coupled" refer to two components joined in a manner such that the components can be readily separated from one another to return to their separate, discrete forms without destroying and/or damaging either component. Exemplary modalities of temporary attachment may include mating-type connections, releasable fasteners, removable stitches, and/or other temporary joining techniques.

As used herein, the terms "lace-receiving structure" (which can also be referred to as a "lace guide") means any type of structure that is configured to receive and retain an adjustment member (e.g., a lace, string, cable, cord, wire, band, strap, etc.) configured for adjusting and/or securing the article of footwear relative to a wearer's foot. As an example, the lace-receiving structure may include an aperture (e.g., eyelet), channel, and/or groove through which the adjustment member is configured to extend. When included in an article of footwear, the lace-receiving structure is configured to adjustably couple the adjustment member to the article of footwear.

As used herein, the terms "articles of footwear," "articles," and/or "footwear" mean any type of footwear, including, for example, casual shoes, walking shoes, sneakers, tennis shoes, running shoes, soccer shoes, football shoes, rugby shoes, basketball shoes, baseball shoes, boots, sandals, etc.

Although the figures may illustrate an article of footwear intended for use on only one foot (e.g., a right foot) of a wearer, one skilled in the art and having the benefit of this disclosure will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, abstract, and drawings.

The Disclosed Technology and Exemplary Embodiments

A lace-receiving structure is configured to receive and an adjustment member (e.g., a lace, string, cable, cord, wire, band, strap, etc.) and may be included in an article of footwear. The lace-receiving structure typically includes an eyelet that is configured to receive the adjustment member and a support structure that is configured to couple the eyelet to the article of footwear. In some examples, the lace-receiving structure may be included in an article of footwear. In such examples, the article of footwear typically includes a sole structure and an upper in addition to the lace-receiving structure. The sole structure is configured for supporting the wearer's foot and providing cushioning between the wearer's foot and the ground. The upper is coupled to the sole structure and forms a foot-receiving cavity. The upper is configured for securing the wearer's foot to the sole structure and/or can protect the wearer's foot.

For example, FIGS. 1-19 depict various embodiments of lace-receiving members. More specifically, FIGS. 1-6 depict various views of a lace-receiving structure 10. FIGS. 7-13 depicts various alternative embodiments of an anchor portion of the lace-receiving structure 10. FIGS. 20-26 depict an exemplary article of footwear comprising lace-receiving structures, according to one embodiment.

Referring now to FIGS. 1-6, the lace-receiving structure 10 comprises two main components: an eyelet 12 and a support structure 14. The eyelet 12 is configured to receive an adjustment member there-through, and the support structure 14 is configured to support and/or stabilize eyelet 12 and/or to couple eyelet 12 to an article of footwear (e.g., article of footwear 900 described below in FIGS. 20-26). The support structure 14 comprises a main body portion 16 and an anchor portion 18. The anchor portion 18 is configured to couple the lace-receiving structure 10 to the article of footwear and may be configured to extend through an upper of the article of footwear and, in some instances, into a foot-receiving cavity of the article of footwear. The main body portion 16 extends from the anchor portion 18 and extends over and/or onto the upper of the article of footwear.

Eyelet 12 may comprise a loop 20 that defines an aperture 22 (which may also be referred to herein as "channel" and/or "opening"), which can receive an adjustment member. The loop 20 itself can be constructed from, formed of, and/or comprise various materials. For example, the loop 20 can be constructed from, formed of, and/or comprise one or more of textiles, foam, leather, synthetic leather, and/or polymers (e.g., rubber and/or plastic). The aperture 22 may extend through the loop 20, from a first side 24 of the loop 20 to a second side 26 of the loop 20 that is opposite the first side 24. The aperture 22 can be one or more of a void, empty space, and/or hollow region that is configured to receive the adjustment member.

The loop 20 may be coupled to the support structure 14. Specifically, the loop 20 may be coupled to the main body portion 16 of the support structure 14. In some embodiments, the loop 20 may be directly coupled to the main body portion 16. In some such embodiments, the loop 20 and the main body portion 16 may be formed as a single, unitary component (e.g., by knitting or molding). In other such embodiments, the loop 20 and the main body portion 16 may be formed separately as two discrete components and may then be coupled directly to one another (e.g., by stitching, adhesive, fasteners, etc.) In other embodiments, the loop 20 may be coupled to the main body portion 16 via one or more intermediate components.

In some embodiments, the loop 20 may be coupled to a first side 28 (which may also be referred to as an "inner side 28" and/or a "shoe-facing side 28" since it may be configured to face the article of footwear when included in and/or coupled to the article of footwear) of the main body portion 16 of the support structure 14 that is opposite a second side 30 of the main body portion 16 (which may also be referred to as an "outer side 30" and/or an "exterior-facing side 30"). In some embodiments, the loop 20 may be coupled farther from a proximal end 32 of the main body portion 16 than a distal end 34 of the main body portion 16. That is, the loop 20 may be positioned more proximate the distal end 34 than the proximal end 32. In some such embodiments, the loop 20 may nonetheless be spaced inwardly away from the distal end 34 by a distance "D." In some further such embodiments, the loop 20 may be spaced away from the distal end 34 by at least 1/10, at least 1/9, at least 1/8, at least 1/7, at least 1/6, at least 1/5, at least 1/4, at least 1/3, at most 1/2, at most 1/3, and/or at most 1/4 of the length of the main body portion 16, where the length of the main body portion 16 is the distance between the proximal end 32 and the distal end 34 of the main body portion 16.

In some such embodiments, the loop 20 may be coupled to the main body portion 16 at a position on the main body portion 16 that is at least 1/10, at least 1/9, at least 1/8, at least 1/7, at least 1/6, at least 1/5, at least 1/4, at least 1/3, at most 1/2, at most 1/3, and/or at most 1/4 of the length of the main body portion 16 away from the distal end 34 of the main body portion 16. That is, the attachment point between the main body portion 16 and the loop 20 (the location on the main body portion 16 where the loop 20 is attached to the main body portion 16) may be located at least 1/10, at least 1/9, at least 1/8, at least 1/7, at least 1/6, at least 1/5, at least 1/4, at least 1/3, at most 1/2, at most 1/3, and/or at most 1/4 of the length of the main body portion 16 away from the distal end 34 of the main body portion 16.

In some embodiments, the distance between the loop 20 and the distal end 34 is fixed and does not change. For example, the loop 20 may be rigid (i.e., may not bend) and/or the loop 20 may be rigidly coupled to the main body portion 16 such that the loop 20 is not configured to bend, rotate, and/or otherwise move relative to the main body portion 16.

However, in other embodiments, the distance between the loop 20 and the distal end 34 is variable. For example, the loop 20 may be configured to bend and/or otherwise move relative to main body portion 16. For example, the loop 20 may be configured to bend towards, pivot towards, compress, deform, and/or flatten against the main body portion 16 (e.g., the distal end 34) when the adjustment members of the article of footwear are tightened and the lace-receiving structure 10 is compressed against the upper of the article of footwear. In particular, the loop 20 may be configured to move between a more extended first position and a flatter second position. In the extended first position, the loop 20 may extend farther away from the main body portion 16 than in the flatter second position.

In some embodiments, the loop 20 itself may be configured to bend and/or deform when a wearer pulls on and/or otherwise tightens the adjustment members (i.e., when a lace-tightening force is applied by a wearer). In one such embodiment, the loop 20 may comprise a flexible material (e.g., fabric) that is configured to bend and/or deform under a compressive force. In another embodiment, the loop 20 may be pivotably coupled to the main body portion 16 and may be configured to pivot relative to the main body portion 16 (e.g., towards the distal end 34).

In embodiments where the loop 20 is configured to move relative to the main body portion 16 (i.e., where the distance between the loop 20 and the distal end 34 is variable), the loop 20 may still be configured to be spaced inwardly away from the distal end 34 by at least 1/20, at least 1/18, at least 1/16, at least 1/14, at least 1/12, at least 1/10, at least 1/9, at least 1/8, at least 1/7, at least 1/6, at least 1/5, at least 1/4, at least 1/3, at most 1/2, at most 1/3, and/or at most 1/4 of the length of the main body portion 16 even at its closest approach to the distal end 34 (such as when the loop 20 is in the flatter second position). In other embodiments, the loop 20 may be spaced inwardly away from the distal end 34 in the more extended first position (e.g., when a lace-tightening force is not applied), but may be located at, aligned with, and/or may extend past the distal end 34 of the main body portion in the flatter second position (e.g., when a the lace-tightening force is applied). In yet further embodiments, the loop 20 may not be spaced inwardly away from the distal end 34 of the main body portion 16, and may be located at, aligned with, and/or may extend past the distal end 34 of the main body portion 16 in both the more extended first position and the flatter second position.

The main body portion 16 may be coupled to the anchor portion 18 at its proximal end 32. In some embodiments, the proximal end 32 may be directly coupled to the anchor portion 18. In some such embodiments, the main body portion and the anchor portion 18 may be formed as a single, unitary component (e.g., by knitting or molding). In other such embodiments, the main body portion and the anchor portion 18 may be formed as two discrete components and thereafter may be coupled directly to one another (e.g., by stitching, adhesive, fasteners, etc.) In other embodiments, the proximal end 32 of the main body portion 16 may be coupled to the anchor portion 18 via one or more intermediate components.

The main body portion 16 and/or the anchor portion 18 may be constructed from, formed of, and/or comprise various materials. For example, the main body portion 16 and/or the anchor portion 18 can be constructed from, formed of, and/or comprise one or more of textiles, foam, leather, synthetic leather, natural polymers and/or synthetic polymers (e.g., synthetic rubber). In some embodiments, the anchor portion 18 and the main body portion 16 may be formed from the same materials. In other embodiments, the anchor portion 18 and the main body portion 16 may be formed from different materials.

As noted above, the inner side 28 of the main body portion 16 may be configured to face the upper of an article of footwear when the lace-receiving structure 10 is included in and/or coupled to the article of footwear. In one embodiment, the inner side 28 of the main body portion 16 may be configured to directly contact at least a portion of the upper (such as when a wearer tightens the adjustment members). The outer side 30 is opposite the inner side 28 and may be configured to face away from the upper of the article of footwear when included in and/or coupled to the article of footwear. The distance between the outer side 30 and the inner side 28 defines the thickness of the main body portion 16. The main body portion 16 also may include a third side 36 (which may also be referred to herein as "first edge 36") and a fourth side 38 (which may also be referred to herein as "second edge 38") that is opposite the third side 36. The third side 36 and fourth side 38 may define and/or be the anterior and/or posterior sides of the main body portion 16. The distance between the third side 36 and the fourth side 38 may define the width of the main body portion 16.

The main body portion 16 may be longer than it is wide and/or thick. That is, the length of the main body portion 16 (the distance between the proximal end 32 and the distal end 34) may be the largest dimension of the main body portion 16. For example, the length of the main body portion 16 may be at least one and a half times, at least two times, at least three times, at least four times, at most ten times, at most eight times, and/or at most six times greater than the width of the main body portion 16. In some embodiments, the main body portion 16 may be wider than it is thick. That is width of the main body portion 16 (the distance between the third side 36 and the fourth side 38 of the main body portion 16) may be greater than the thickness of the main body portion (the distance between the inner side 28 and the outer side 30). For example, the width of the main body portion 16 may be at least two times, at least four times, at least 6 times, at least 8 times, at least 10 times, at least 15 times, at least 20 times, at most one hundred times, at most eighty times, and/or at most sixty times, the thickness of the main body portion 16. In some embodiment, the width and/or thickness of the main body portion 16 may be uniform. However, in other embodiments, and as will be discussed in greater detail below with reference to FIGS. 14-19, the width and/or thickness of the main body portion 16 may not be uniform and/or may vary along the length of the main body portion 16.

Thus, although depicted schematically as a rectangular prism in FIGS. 1-13, the main body portion 16 may comprise other shapes. For example, the width of the main body portion 16 may taper along the length of the main body portion 16. As one such example, the main body portion 16 may be wider nearer its proximal end 32 and narrower nearer its distal end 34 (i.e., it may taper towards the distal end 34). In one such example, the main body portion 16 may monotonically narrow (the width may monotonically decrease) when progressing away from the proximal end 32 towards the distal end 34. As another example, the thickness of the main body portion 16 may taper along the length of the main body portion 16. In one such example, the main body portion 16 may be thicker nearer its proximal end 32 and thinner nearer its distal end 34. In one such example, the main body portion 16 may monotonically thin (the thickness may monotonically decrease) when progressing away from the proximal end 32 towards the distal end 34.

Anchor portion 18 (which may also be referred to herein as "flange 18") may be configured to couple the lace-receiving structure 10 to the article of footwear. Anchor portion 18 may extend from the proximal end 32 of the main body portion 16 at an angle relative to the main body portion 16. In one embodiment, the anchor portion 18 may extend substantially orthogonally relative to the proximal end 32 of the main body portion 16. However, in other examples, the anchor portion 18 may extend away from the proximal end 32 of the main body portion 16 at an angle of at least 20 degrees, at least 30 degrees, at least 50 degrees, at least 60 degrees, at least 70 degrees, at least 80 degrees, at least 90 degrees, at most 160 degrees, at most 150 degrees, at most 140 degrees, at most 130 degrees, at most 120 degrees, at most 110 degrees, at most 100 degrees, and/or at most 90 degrees.

Anchor portion 18 may include a first side 42 (which may also be referred to herein as "the upper side 42" and/or the "upper-facing side 42" since it may be configured to face and/or directly contact an inner surface of the upper when included in the article of footwear) and a second side 44 (which may also be referred to herein as "the lower side 44" and/or the "foot-facing side 44 since it may be configured to face and/or directly contact a wearer's foot when included in the article of footwear) opposite the first side 42. The distance between the first side 42 and the second side 44 may define the thickness of the anchor portion 18. The anchor portion 18 may also include a first end 46, a second end 48 opposite the first end 46, a first edge 50, and a second edge 52 opposite the first edge 50. The distance between the first end 46 and the second end 48 may define the length of the anchor portion 18, and the distance between the first edge 50 and the second edge 52 may define the width of the anchor portion 18.

Figure 2:
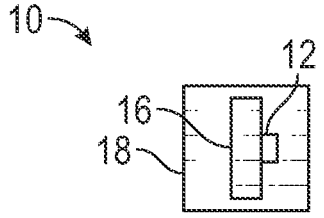
FIG. 2 is a top view of the lace-receiving structure of FIG. 1.
Figure 3:
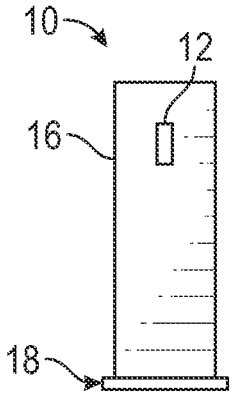
FIG. 3 is a first side view of the lace-receiving structure of FIG. 1.
Figure 4:
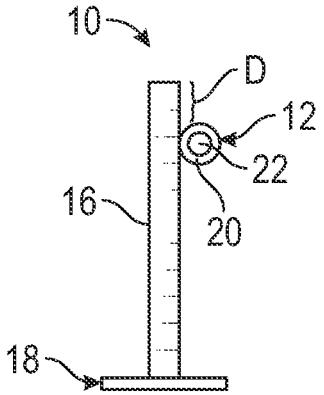
FIG. 4 is a first end view of the lace-receiving structure of FIG. 1
Figure 5:
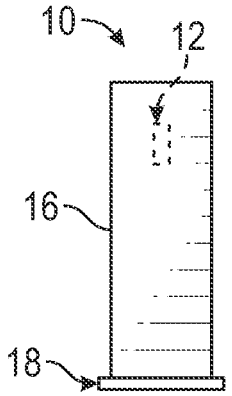
FIG. 5 is a second side view of the lace-receiving structure of FIG. 1.
Figure 6:
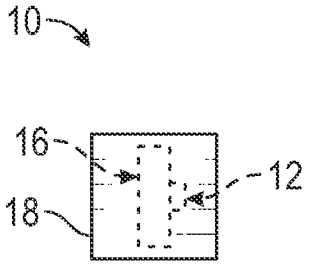
FIG. 6 is a bottom view of the lace-receiving structure of FIG. 1

Although the anchor portion 18 is illustrated as having a generally rectangular profile when viewed from above (looking down at the first side 42) or below (looking up at second side 44) in FIGS. 2 and 6, respectively, it should be appreciated that the anchor portion 18 may be shaped differently in other embodiments. For example, referring to FIGS. 9 and 10, the profile of the anchor portion 18 when viewed from above or below may comprise two differently sized rectangles that are conjoined along a common edge. Further, although the anchor portion 18 is illustrated as being large enough such that all of its edges and ends (first end 46, second end 48, first edge 50, and second edge 52) extend beyond the first side 28, second side 30, third side 36, and fourth side 38 of the main body portion 16, it should be appreciated that the anchor portion 18 may be sized differently in other embodiments. For example, referring to FIGS. 11 and 12, the width of the anchor portion 18 may be alternatively sized such that the first edge 50 and second edge 52 of the anchor portion 18 are substantially flush and/or aligned with the third side 36 and fourth side 38 of the main body portion 16, respectively. In this arrangement, the width of the anchor portion 18 is substantially the same as the width of the main body portion 16.

In some embodiments the anchor portion 18 may be longer and/or wider than it is thick. That is, the length (the distance between the first end 46 and the second end 48) and width (the distance between the first edge 50 and the second edge 52) of the anchor portion 18 may be greater than the thickness (the distance between the first side 42 and the second side 44) of the anchor portion 18. For example, the length and/or width of the anchor portion 18 may be at least one and a half times, at least two times, at least three times, at least four times, at least six times, at least eight times, at least ten times, at most forty times, at most thirty times, and/or at most twenty times greater than the thickness of the anchor portion 18. In some embodiments, the width and/or thickness of the anchor portion 18 may be uniform. However, in other embodiments, and as will be discussed in greater detail below with reference to FIGS. 14-19, the width and/or thickness of the anchor portion 18 may not be uniform and/or may vary along the length of the anchor portion 18.

Thus, although depicted schematically as a rectangular prism in FIGS. 1-13, the anchor portion 18 may comprise other shapes. For example, the width and/or thickness of the anchor portion 18 may taper along the length of the anchor portion. As one such example, the anchor portion 18 may be wider and/or thicker nearer the main body portion 16 and narrower and/or thinner nearer the first end 46, second end 48, first edge 50 and/or second edge 52 (i.e., it may taper towards the sides and/or edges). In one such example, the anchor portion 18 may monotonically narrow (the width may monotonically decrease) and/or monotonically thin (the thickness may monotonically decrease) when progressing away from the main body portion 16 towards one or more of the first end 46, second end 48, first edge 50, and/or second edge 52.

In some embodiments, main body portion 16 may be directly coupled to and/or may extend from the first side 42 of the anchor portion 18. In some such embodiments, the proximal end 32 of the main body portion 16 may be directly coupled to the first side 42 of the anchor portion 18. In some embodiments (such as those illustrated in FIGS. 1-6), main body portion 16 may be positioned substantially in the center of the first side 42 of the anchor portion 18 such that first side 28 and the second side 30 are positioned the same distance from the first end 46 and the second end 48, respectively, of the anchor portion 18 and such that the third side 36 and the fourth side 38 are positioned the same distance from the first edge 50 and the second edge 52, respectively, of the anchor portion 18.

In other embodiments, main body portion 16 may be directly coupled to and/or may extend from the first end 46 and/or the second end 48. In some such embodiments, the first side 28 and/or the second side 30 of the main body portion 16 may be directly coupled to the first end 46 and/or the second end 48 of the anchor portion 18. In some such embodiments, the proximal end 32 of the main body portion 16 may be substantially flush and/or aligned with the second side 44 of the anchor portion 18. In other such embodiments, the proximal end 32 of the main body portion 16 may extend past the second side 44 of the anchor portion 18.

The lace-receiving structure 10 may be stiffest (i.e., may have a higher Young's modulus) at and/or near where the main body portion 16 and the anchor portion 18 meet and/or are coupled to one another. As one example, the lace-receiving structure 10 may be thickest where the main body portion 16 and the anchor portion 18 meet. Additionally or alternatively, the lace-receiving structure 10 may be constructed from a different, stiffer material at and/or near where the main body portion 16 and the anchor portion 18 meet and/or are coupled to one another than at more distal ends of the main body portion 16 and/or anchor portion 18. In this way, the lace-receiving structure 10 may be configured to bend and/or deform more easily more proximate the distal ends of the main body portion 16 and/or the anchor portion 18 and may be configured to be more rigid nearer where the main body portion 16 and anchor portion 18 meet. Such a configuration may permit the main body portion 16 and/or anchor portion 18 to each individually bend, but may restrict bending of the main body portion 16 and anchor portion 18 relative to one another where the meet and/or are coupled to one another.

FIGS. 7-13 depict various embodiments for the relative sizing and positioning of the anchor portion and the main body portion, as well as various embodiments for the shape of the anchor portion.

Figure 7:
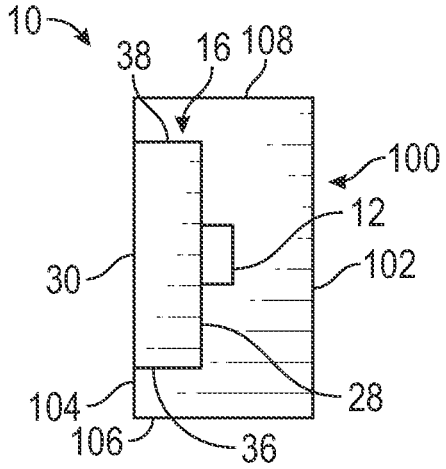
FIG. 7 is a top view of another exemplary embodiment of a lace-receiving structure.

FIG. 7 depicts the lace-receiving structure 10, which comprises an anchor portion 100 in lieu of the anchor portion 18. In the illustrated embodiment, a first end 102, a first edge 106, and a second edge 108 of the anchor portion 100 extend radially outwardly from the main body portion 16, and the second side 30 of the main body portion 16 is flush and/or aligned with a second end 104 of the anchor portion 100.

Figure 8:
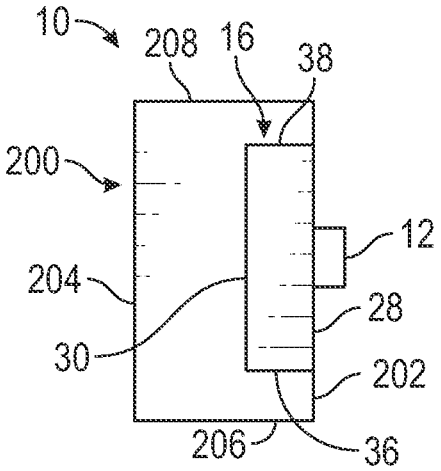
FIG. 8 is a top view of another exemplary embodiment of a lace-receiving structure.

FIG. 8 depicts the lace-receiving structure 10, which comprises an anchor portion 200 in lieu of the anchor portion 18. In the illustrated embodiment, the first side 28 of the main body portion 16 is flush and/or aligned with a first end 202 of the anchor portion 200, and a first edge 206, a second edge 208, and a second end 204 of the anchor portion 200 extend radially outwardly from the main body portion 16.

Figure 9:
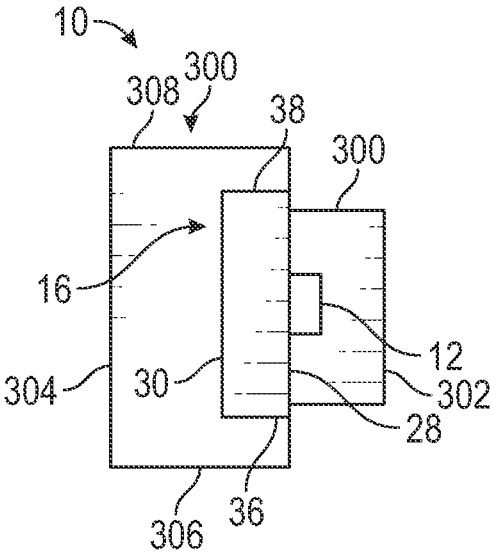
FIG. 9 is a top view of another exemplary embodiment of a lace-receiving structure.
Figure 10:
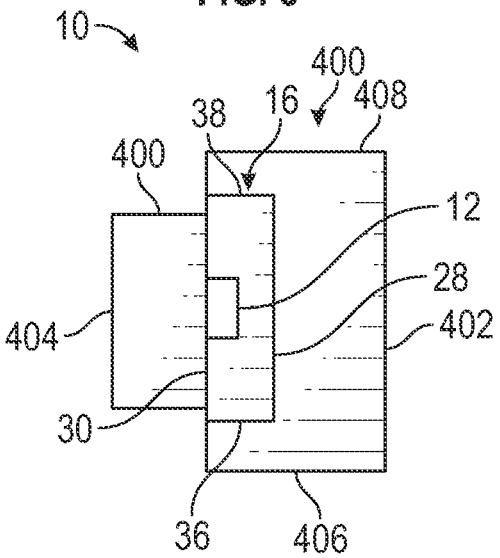
FIG. 10 is a top view of another exemplary embodiment of a lace-receiving structure.

FIGS. 9-10 depict the lace-receiving structure 10, which comprises anchor portions that comprise two differently sized projections.

FIG. 9 depicts the lace-receiving structure 10, which comprises an anchor portion 300 in lieu of the anchor portion 18. In the illustrated embodiment, a first end 302, a second end 304, a first edge 306, and a second edge 308 of the anchor portion 300 extend radially outwardly from the main body portion 16. However, the anchor portion 300 comprises two differently sized projections (when viewed from above) conjoined at a common edge that is aligned and/or flush with the first side of the main body portion 16, such that the section of the anchor portion 300 that projects radially outwardly from the first side 28 of the main body portion 16 is narrower than (i.e., not as wide as) the main body portion 16, and the section of the anchor portion 300 that extends underneath the main body portion 16 and extends radially outwardly from the second side 30 of the main body portion 16 is wider than the main body portion 16. In this way, the first edge 306 and second edge 308 of the anchor portion 300 do not extend radially outwardly from the main body portion 16 in the section that extends radially outwardly from the first side 28 of the main body portion 16, whereas the first edge 306 and second edge 308 of the anchor portion 300 extend radially outwardly from the main body portion 16 in the section of the anchor portion 300 that extends underneath the main body portion 16 and radially outwardly from the second side 30 of the main body portion 16.

FIG. 10 depicts the lace-receiving structure 10, which comprises an anchor portion 400 in lieu of the anchor portion 18. Anchor portion 400 is a mirror image of anchor portion 300. Thus, in the illustrated embodiment, the narrower section of the anchor portion 400 extends radially outwardly from the second side 30 of the main body portion 16, and the wider section of the anchor portion 400 extends underneath the main body portion 16 and radially outwardly from the first side 28 of the main body portion 16. Thus, a first end 402, a second end 404, a first edge 406, and a second edge 408 of the anchor portion 400 extend radially outwardly from the main body portion 16, but the first edge 406 and second edge 408 of the anchor portion 400 do not extend radially outwardly from the main body portion 16 in the section that extends radially outwardly from the second side 30 of the main body portion 16, whereas the first edge 406 and second edge 408 of the anchor portion 400 extend radially outwardly from the main body portion 16 in the section of the anchor portion 400 that extends underneath the main body portion 16 and radially outwardly from the first side 28 of the main body portion 16.

Figure 11:
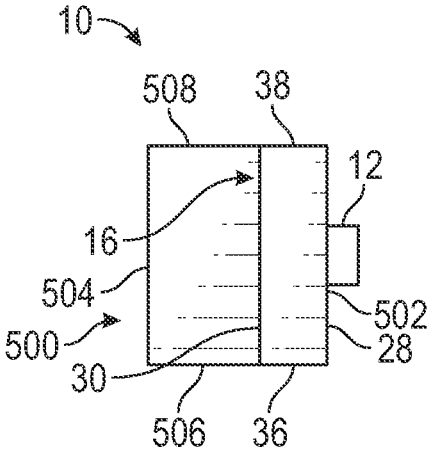
FIG. 11 is a top view of another exemplary embodiment of a lace-receiving structure.
Figure 12:
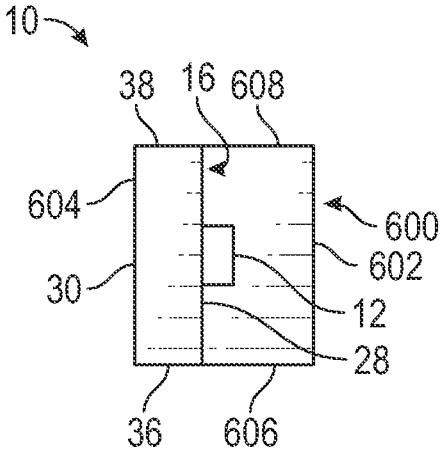
FIG. 12 is a top view of another exemplary embodiment of a lace-receiving structure.
Figure 13:
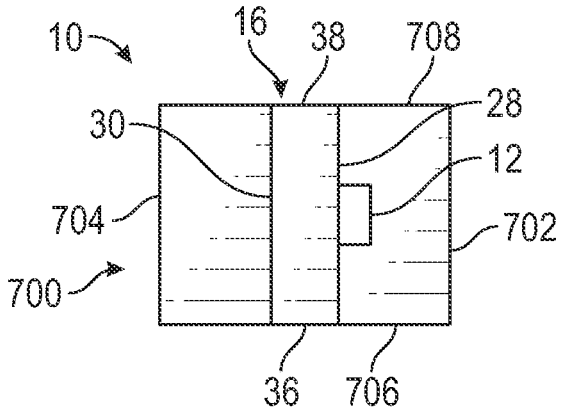
FIG. 13 is a top view of yet another exemplary embodiment of a lace-receiving structure.

FIGS. 11-13 depict the lace-receiving structure 10, which comprises anchor portions that are substantially the same width as the main body portion 16 such that the edges of the anchor portions do not extend radially outwardly from the third side 36 and fourth side 38 of the main body portion 16.

In particular, FIG. 11 depicts the lace-receiving structure 10 comprising an anchor portion 500 in lieu of the anchor portion 18. In the illustrated embodiment, a first end 502 of the anchor portion 500 is aligned and/or flush with the first side 28 of the main body portion 16, a second end 504 of the anchor portion 500 extends radially outwardly from the second side 30 of the main body portion 16, a first edge 506 of the anchor portion 500 is aligned and/or flush with the third side 36 of the main body portion 16, a second edge 508 of the anchor portion 500 is aligned and/or flush with the fourth side 38 of the main body portion 16.

FIG. 12 depicts the lace-receiving structure 10, which comprises an anchor portion 600 in lieu of the anchor portion 18. In the illustrated embodiment, a first end 602 of the anchor portion 600 extends radially outwardly from the first side 28 of the main body portion 16, a second end 604 of the anchor portion 600 is aligned and/or flush with the second side 30 the main body portion 16, a first edge 606 of the anchor portion 600 is aligned and/or flush with the third side 36 of the main body portion 16, and a second edge 608 of the anchor portion 600 is aligned and/or flush with the fourth side 38 of the main body portion 16.

FIG. 13 depicts the lace-receiving structure 10, which comprises an anchor portion 700 in lieu of the anchor portion 18. In the illustrated embodiment, a first end 702 of the anchor portion 700 extends radially outwardly from the first side 28 of the main body portion 16, a second end 704 of the anchor portion 700 radially outwardly from the second side 30 the main body portion 16, a first edge 706 of the anchor portion 700 is aligned and/or flush with the third side 36 of the main body portion 16, a second edge 708 of the anchor portion 700 is aligned and/or flush with the fourth side 38 of the main body portion 16, and. Thus, the lace-receiving structure 10 may be substantially T-shaped when it includes anchor portion 700.

In some embodiments, the main body portion 16 may be longer than the anchor portion (e.g., anchor portion 18, anchor portion 100, anchor portion 200, anchor portion 300, anchor portion 400, etc.). For example, the length of the main body portion 16 (distance between the proximal end 32 and the distal end 34) may be greater than the length of the anchor portion (e.g., distance between the first end 46 and the second end 48) by at least one and a half, at least two, at least three, at least four, at least five, at least six, at least eight, at least ten, at least twelve, at most eighty, at most sixty, at most forty, at most twenty, at most fifteen, times the length of the anchor portion 18. In some embodiments, the main body portion 16 may be thicker than the anchor portion. For example, the average thickness of the main body portion 16 may be at least one and a half, at least two, at least three, at least four, at most twenty, at most fifteen, and/or at most ten times the average thickness of the anchor portion.

FIGS. 14-19 depict an exemplary lace-receiving structure 800. The lace-receiving structure 800 may comprise one or more components that are generally similar to one or more components of the lace-receiving structure 10. Thus, for conciseness, the components of the lace-receiving structure 800 that are similar to the components of lace-receiving structure 10 are labeled similarly and may not include additional description. For example, the lace-receiving structure 800 comprises an eyelet 812 and a support structure 814, which comprises a main body portion 816 and an anchor portion 818 (corresponding to the components the eyelet 12, the support structure 14, the main body portion 16, and the anchor portion 18 of the lace-receiving structure 10, respectively).

In the embodiment of FIGS. 14-19, a proximal end 832 of the main body portion 816 may be directly coupled to a first end 846 of the anchor portion 818. For example, this particular configuration of the lace-receiving structure 800 may be used on the lateral side of a right-footed shoe and/or the medial side of a left-footed shoe. However, it should be appreciated that the proximal end 832 of the main body portion 816 may alternatively be directly coupled to a second end 848 of the anchor portion 818 (such as for use on the medial side of a right-footed shoe and/or the lateral side of a left-footed shoe).

Main body portion 816 and anchor portion 818 of lace-receiving structure 800 may form a corner 802 where they meet (e.g., where the proximal end 832 of the main body portion 816 and the first end 846 of the anchor portion 818 meet). The lace-receiving structure 800 may be stiffer at the corner 802 than a distal end 834 of the main body portion 816 and/or the distal ends of the anchor portion 818 (e.g., the second end 848 of the anchor portion 818 in examples where the main body portion 816 is coupled to the anchor portion 818 at the first end 846). Thus, the lace-receiving structure 800 may be stiffer at the proximal end 832 of the main body portion 816 than at the distal end 834 of the main body portion 816, and/or may be stiffer at the first end 846 of the anchor portion 818 than at the second end 848 of the anchor portion 818 (in examples where the main body portion 816 is coupled to the anchor portion 818 at the first end 846 of the anchor portion 818). In some examples, the stiffness of the lace-receiving structure 800 may monotonically decrease when progressing away from the corner 802 towards the distal end 834 of the main body portion 816 and/or the distal ends of the anchor portion 818, and vice versa (the stiffness of the lace-receiving structure 800 may monotonically increase when progressing towards the corner 802 away from the distal ends of the anchor portion 818 and/or the distal end 834 of the main body portion 816).

Figure 14:
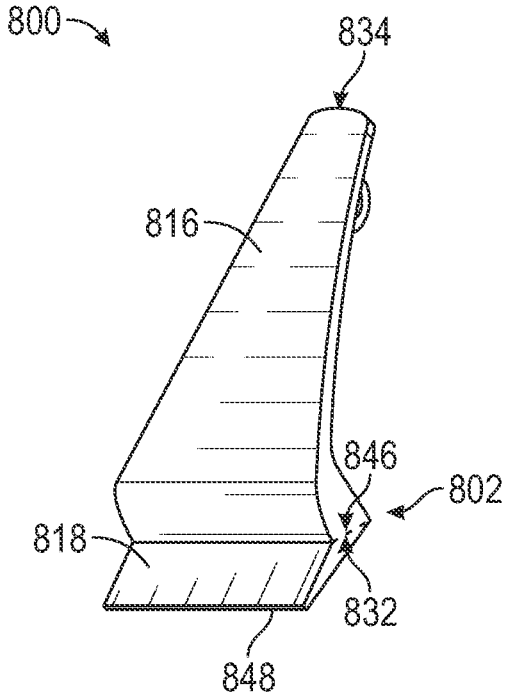
FIG. 14 is a perspective view of an exemplary lace-receiving structure, according to another embodiment.
Figure 18:
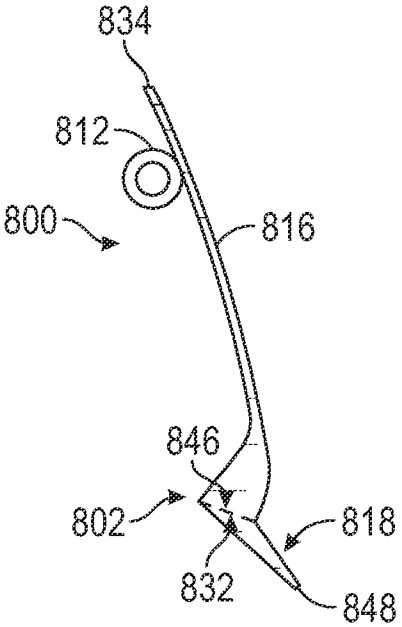
FIG. 18 is a second end view of the lace-receiving structure of FIG. 14.
Figure 19:
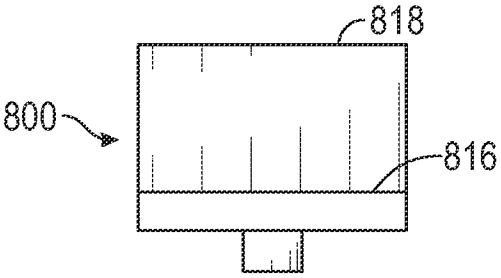
FIG. 19 is a top view of the lace-receiving structure of FIG. 14.
Figure 15:
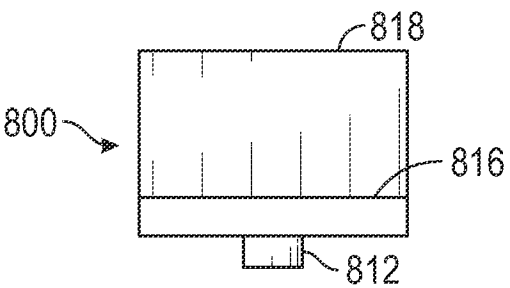
FIG. 15 is a bottom view of the lace-receiving structure of FIG. 14.
Figure 17:
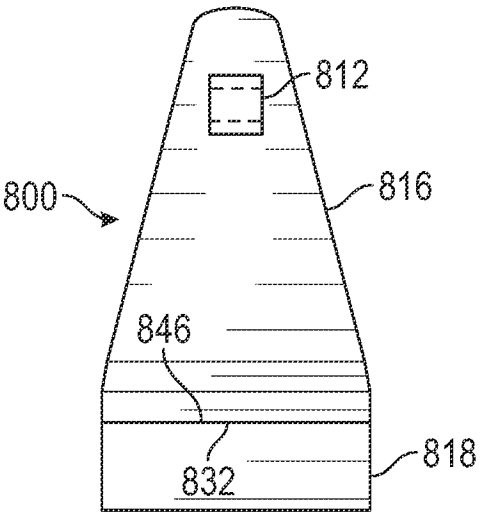
FIG. 17 is a first side view of the lace-receiving structure of FIG. 14.
Figure 16:
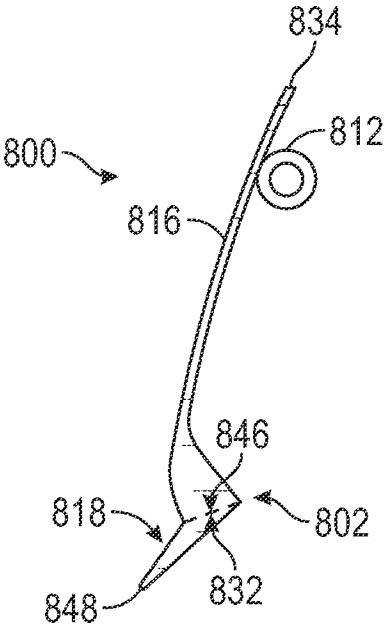
FIG. 16 is a first end view of the lace-receiving structure of FIG. 14.

In some embodiments, the lace-receiving structure 800 may be stiffer at the corner 802 by virtue of being thicker at the corner 802. For example, as illustrated in FIGS. 14 and 17, the main body portion 816 is thicker nearer the proximal end 832 than the distal end 834, and the anchor portion 818 is thicker nearer the first end 846 than the second end 848 (in examples where the main body portion 816 is coupled to the anchor portion 818 at the first end 846). Specifically, the thickness of the main body portion 816 of the exemplary lace-receiving structure 800 tapers towards the distal end 834 of the main body portion 816 (i.e., the thickness of the main body portion 816 decreases when progressing away from the proximal end 832 towards the distal end 834). Similarly, the thickness of the anchor portion 818 tapers towards the second end 848 in examples where the main body portion 816 is coupled to the first end 846 of the anchor portion 818 (i.e., the thickness of the anchor portion 818 decreases when progressing away from the first end 846 towards the second end 848). In some such embodiments, the lace-receiving structure 800 is thickest at and/or near the corner 802.

Additionally or alternatively, the lace-receiving structure 800 may be stiffer nearer the corner 802 because it may be constructed from one or more different, stiffer materials nearer the corner 802 than the distal ends of the main body portion 816 and/or anchor portion 818. For example, the main body portion 816 may comprise a harder and/or stiffer rubber nearer the corner 802 and a softer and/or more flexible rubber nearer the distal end 834. In this way, the lace-receiving structure 800 may be configured to be more rigid nearer the corner 802 and may be configured to bend and/or deform more easily nearer the distal end 834 of the main body portion 816 and/or the distal ends of the anchor portion 818 than the corner 802.

In some embodiments, the width of the main body portion 816 and/or the anchor portion 818 also or alternatively tapers towards the distal ends of the main body portion 816 and/or the anchor portion 818. In one such embodiment, the width of the main body portion 816 of the exemplary lace-receiving structure 800 tapers towards the distal end 834 of the main body portion 816 (i.e., the width of the main body portion 816 decreases when progressing away from the proximal end 832 towards the distal end 834). In another such embodiment, the width of the anchor portion 818 tapers towards the second end 848 in examples where the main body portion 816 is coupled to the first end 846 of the anchor portion 818 (i.e., the width of the anchor portion 818 decreases when progressing away from the first end 846 towards the second end 848).

FIGS. 20-26 depict an exemplary article of footwear 900 that includes a plurality the lace-receiving structures 800. In the depicted embodiment, the article of footwear 900 includes two pair of lace-receiving structures 800 (e.g., two lace-receiving structures on the lateral side (FIG. 20) of the article of footwear and two lace-receiving structures on the medial side (FIG. 21) of the article of footwear). As used herein, "a pair of lace-receiving structures" means two lace-receiving structure, including a first lace-receiving structure on a first side (e.g., a lateral side) of the article of footwear and a second lace-receiving structure on a second side (e.g., a medial side) of the article of footwear. In other embodiments, an article of footwear can include more or less than two pairs of lace-receiving structures (e.g., 1-6 pairs). In other embodiments, an article of footwear may include one or more lace-receiving structures that are not arranged in pairs. For example, in one particular embodiment, an article of footwear can comprise a single lace-receiving structure (e.g., on the medial side or the lateral side). In other embodiments, an article of footwear can comprise a plurality of lace-receiving structures on a first side of the article of footwear (e.g., two lace-receiving structures on a lateral side) and fewer lace-receiving structures on a second side of the article of footwear (e.g., 0-1 lace-receiving structures on a medial side).

The article of footwear 900 comprises a sole structure 902 and an upper 904. The upper 904 is coupled to and extends from the sole structure 902 so as to form a foot-receiving cavity 906 between the sole structure 902 and the upper 904. The foot-receiving cavity 906 is configured to receive a wearer's foot. In some embodiments, the foot-receiving cavity 906 is further configured to expand to initially receive the wearer's foot and thereafter contract to retain the wearer's foot. For example, the article of footwear 900 may include a closure system 907 that is configured to tighten, constrict, and/or otherwise reduce the volume of the foot-receiving cavity 906. As discussed in greater detail below, in some embodiments, the closure system 907 may comprise one or more eyelets 926, an adjustment member 928, and one or more lace receiving members 800.

The footwear 900 may be divided into one or more portions (which may also be referred to as "zones" or "regions"). For example, the portions may include a forefoot portion 908, a midfoot portion 910, and a heel portion 912. The forefoot portion 908 of the footwear 900 may correspond to anterior portions of a foot, including toes and joints connecting metatarsal bones with phalanx bones of the foot. The midfoot portion 910 of the footwear 900 may correspond with an arch area of the foot. The heel portion 912 of the footwear 900 may correspond with posterior portions of the foot, including a calcaneus bone.

Figure 20:
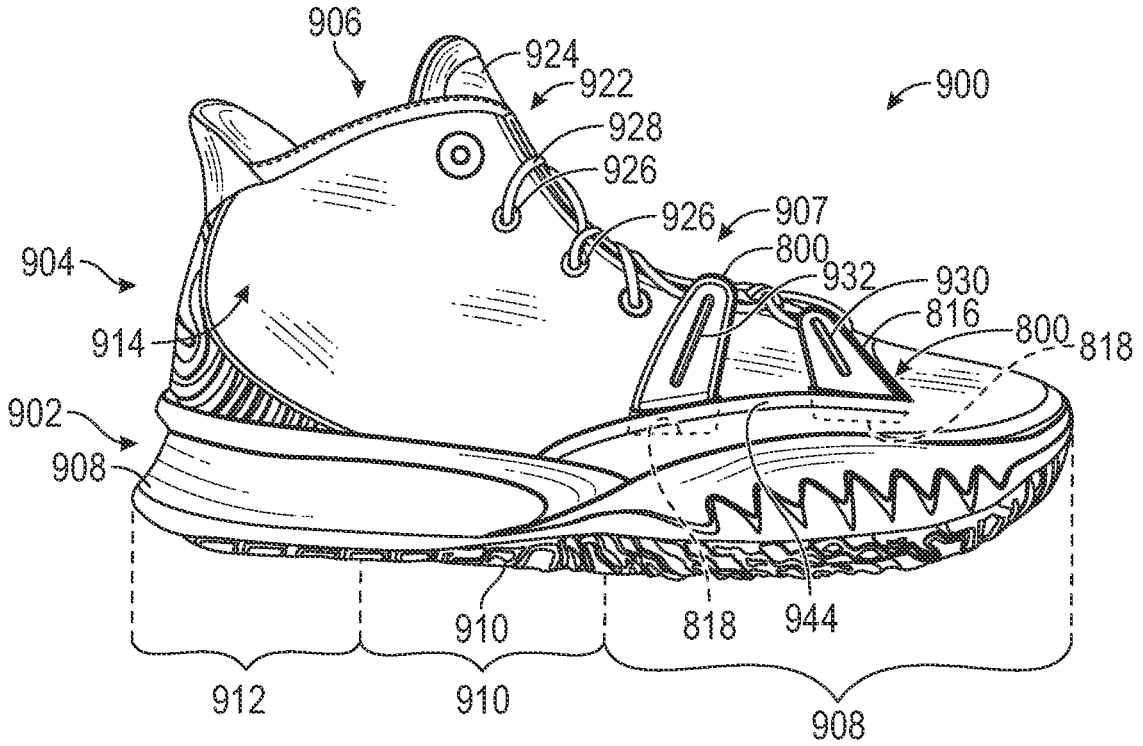
FIG. 20 is a lateral side view of an article of footwear comprising a plurality of lace-receiving structures of FIGS. 14-19.
Figure 21:
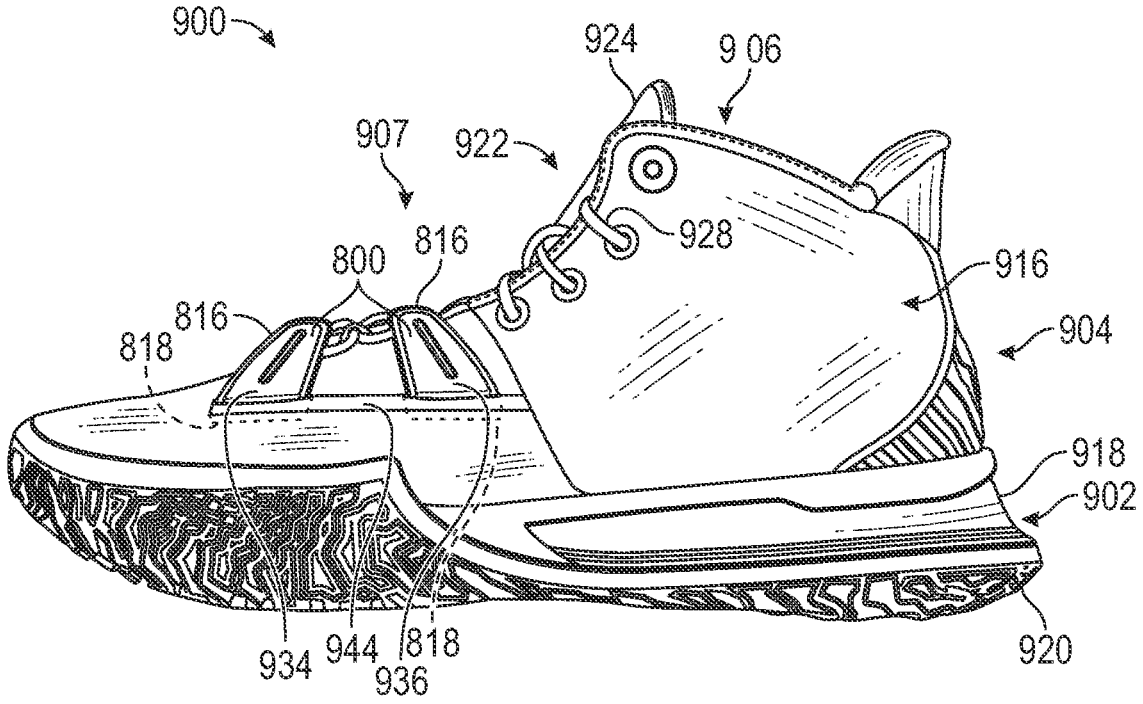
FIG. 21 is a medial side view of the article of footwear of FIG. 20.

The footwear 900 may also be divided into a lateral side 914 and a medial side 916, both of which extend through the forefoot portion 908, the midfoot portion 910, and the heel portion 912. For example, FIG. 20 depicts the lateral side 914 of the footwear 900, and FIG. 21 depicts the medial side 916 of the footwear 900.

Sole structure 902 comprises a midsole 918 and an outsole 920. In the illustrated embodiment, the midsole 918 and the outsole 920 are formed as separate components that are fixedly coupled together. This can be accomplished in various ways, including with adhesive, fasteners, stitching, and/or other means for fastening. In other embodiments, the midsole 918 and the outsole 920 may be integrally formed as a unitary component.

The midsole 918 of the sole structure 902 is configured to be positioned under the wearer's foot. As such, the midsole 918 may, for example, be configured to provide cushioning and support. The midsole 118 may be configured to flex and/or elastically deform as the wearer's foot applies pressure upon the midsole 918 and/or as the footwear 900 impacts a ground surface. In some embodiments, the midsole 918 may comprise a relatively flexible foam material.

The outsole 920 of the sole structure 902 is configured to be positioned between the midsole 918 and the ground surface. Accordingly, the outsole 920 may, for example, be configured to provide increased traction and/or to protect the midsole 918. In some embodiments, the outsole 120 may comprise various traction elements (e.g., nubs, ribs, cleats, lugs, patterns, etc.) configured for engaging one or more types of ground surfaces. In some embodiments, the outsole 920 may comprise a flexible polymeric material (e.g., rubber).

In some embodiments, the sole structure 902 may also comprise one or more additional components. For example, the sole structure 902 may include one or more cushioning elements (e.g., a fluid-filled capsule such as an airbag) and/or foam member (e.g., a foam pad).

The upper 904 comprises a throat portion 922 separating the lateral side of the upper 904 and the medial side of the upper 904. The upper 904 also comprises a tongue 924 disposed at least partially within the throat portion 922. In other embodiments, the upper 904 may be formed without a throat portion and/or a tongue.

The upper 904 of the footwear 900 may be formed of various materials. For example, the upper 904 may be formed of one or more of the following materials: textiles, foam, leather, polymers, and/or synthetic leather. In some embodiments, the upper 904 may be formed as a single, unitary component (e.g., by knitting or molding). In other embodiments, the upper 904 may comprise a plurality of components that are coupled together (e.g., by stitching, adhesive, fasteners, etc.).

The upper 904 may be fixedly coupled to the sole structure 902 in various ways. For example, the upper 904 may be attached (e.g., stitched) to a strobel, and the strobel may be attached to the midsole 918 (e.g., with an adhesive). In other embodiments, the strobel may be omitted, and the upper 904 may be attached to a component of the sole structure 902. In some such embodiments, the upper 904 may be attached to the midsole 918 and/or a cushioning element (e.g., an airbag) of the sole structure 902 via adhesive, stitching, and/or other means for coupling.

The closure system 907 may include the lace-receiving structures 800, the eyelets 926 in the tongue 924 and/or upper 904, and the adjustment member 928. The adjustment member 928 may comprise a lace, wire, cable, strap, and/or other tightening element that is configured to be adjusted (e.g., pulled) by a user to tighten the upper 904 (and thereby reduce the volume of the foot-receiving cavity 906). As described above, the lace-receiving structures 800 may be configured to receive the adjustment member 928. Thus, the adjustment member 928 may be configured to extend through the lace-receiving structures 800 (e.g., through the eyelets 812 of the lace-receiving structures 800), and/or the one or more of the eyelets 926 of the upper 904 and/or tongue 924. To fasten and/or secure the footwear 900 to their foot, a user may pull on the adjustment member 928 to tighten the upper 904 around their foot. Specifically, pulling on the adjustment member 928 may force the eyelets 926 and/or eyelets 12 towards one another, thereby constricting the foot-receiving cavity 906. After tightening the footwear 900 to a desired level via the adjustment member 928, a user may secure the adjustment member 928 in a tightened position by, for example, tying the adjustment member 928 in a knot. Alternatively, the closure system 907 may include a locking mechanism that secures the adjustment member 928 in a particular position and does not require a user to tie a knot.

The lace-receiving structure 800 may be included in the forefoot portion 908 of the footwear 900. However, in other embodiments the lace-receiving structure 800 may additionally or alternatively be included in the midfoot portion 910 of the footwear 900. Further, although the footwear 900 is depicted as including four of the lace-receiving structures 800 in FIGS. 20-24, it should be appreciated that more or less than four of the lace-receiving structures 800 may be included in the footwear 900 in other examples. For example, the footwear 900 may include one, two, three, and/or four of the lace-receiving structures 800 on the lateral side 914 and/or one, two, three, and/or four of the lace-receiving structures 800 on the medial side 916.

In some embodiments, not all the lace-receiving structures 800 may be the same size and/or shape. For example, as depicted in FIGS. 20-24, the forwardmost lace-receiving structure on the lateral side 914 may be shorter and/or narrower the lace-receiving structure 800 positioned rearward of the forwardmost lace-receiving structure on the lateral side 914. In some such embodiments, the lace-receiving structures 800 included in the footwear 900 are all sized and/or shaped differently from one another, such that each of one of the lace-receiving structures 800 is uniquely sized and/or shaped and may be configured to be positioned at a specific location on the footwear 900. For example, in FIGS. 20-24, the footwear 900 may include four different types (e.g., sizes and/or shapes) of the lace-receiving structures 800: a first type 930 that is configured to only be positioned at the forward lateral side position, a second type 932 that is configured to only be positioned at the rearward lateral side position, a third type 934 that is configured to only be positioned at the forward medial side position, and a fourth type 936 that is configured to only be positioned at the rearward medial side position. In this way, each type of lace-receiving structure 800 may be configured to only fit at a specific location/position on the footwear 900. However, in other examples, the lace-receiving structures 800 may be interchangeable at different locations on the footwear 900.

As discussed above, lace-receiving structures 800 may be coupled to upper 904. In some embodiments, lace-receiving structures 800 may be fixedly (e.g., permanently) coupled to upper 904 via stitching, adhesive, thermal bonding, and/or other means for fixedly coupling. Specifically, the anchor portion 818 may be directly fixedly coupled to upper 904. However, in other embodiments, lace-receiving structures 800 may be removably coupled to upper 904. When the lace-receiving structures 800 is removably coupled to the upper 904, a user may interchange the lace-receiving structures 800 as desired, such as for lace-receiving structures 800 having different sizes, shapes, designs, surface features, and/or colors. In some such embodiments where the lace-receiving structures 800 are removably coupled to the upper 904, the lace-receiving structures 800 may not be stitched and/or adhered to the upper 904. Instead, the anchor portion 818 may hold the lace-receiving structure 800 in place by virtue of it extending laterally, medially, and/or longitudinally underneath the upper 904.

Specifically, each lace-receiving structure 800 may extend through an aperture 938 (best seen in FIG. 24) in the upper 904, and the anchor portion 818 may extend below and/or beneath an exterior surface 940 of the upper 904 (best seen in FIGS. 25-26). For example, in FIGS. 20-23, the anchor portion 818 is illustrated in dotted lines to show that it not visible from outside the footwear 900 and instead extends underneath the exterior surface 940 of the upper 904. In embodiments where the lace-receiving structure 800 is removably coupled to the footwear 900, a user may insert the lace-receiving structure 800 through the aperture 938.

Figure 25:
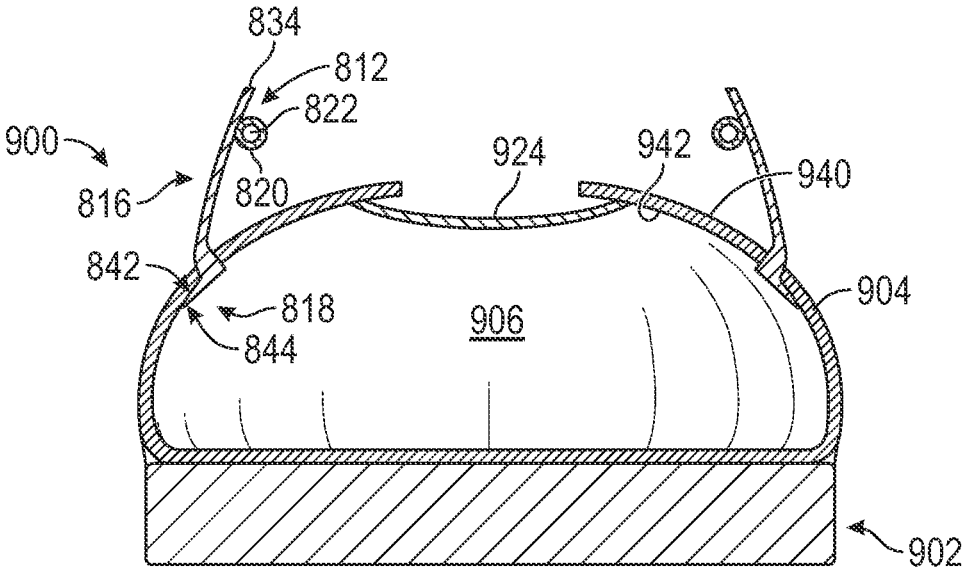
FIG. 25 is a cross-sectional view of the article of footwear of FIG. 20 taken along the line 25-25 shown in FIG. 22 and depicting the lace-receiving structure of the article of footwear in a loose configuration.
Figure 26:
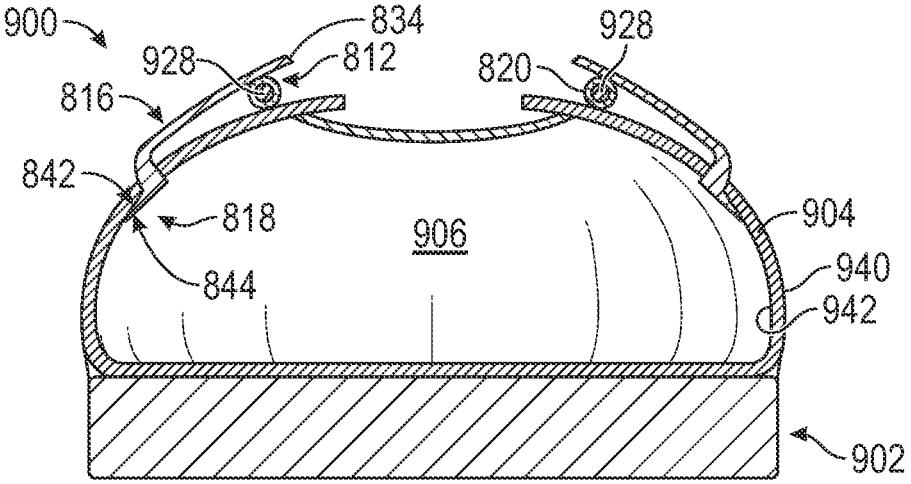
FIG. 26 is a cross-sectional view of the article of footwear of FIG. 20 taken from a perspective similar to that depicted in FIG. 25 and depicting the lace-receiving structure of the article of footwear in a tight configuration.

In some embodiments, such as is depicted in FIGS. 25-26, the anchor portion 818 extends underneath the upper 904 such that it is configured to extend underneath an interior surface 942 of the upper 904 and/or be in direct physical contact with a wearer's foot. Specifically, a second side 844 of the anchor portion 818 may face and/or directly contact a wearer's foot, and the first side 842 of the anchor portion 818 may face and/or directly contact the interior surface 942 of the upper 904. In this way, the anchor portion 818 may be positioned between the upper 904 and the foot-receiving cavity 906 and/or may delimit at least a portion of the foot-receiving cavity 906.

By extending under the upper 904, the anchor portion 818 may hold the lace-receiving structure 800 in the footwear 900. Specifically, because the anchor portion 818 may extend underneath the upper 904 when included in the footwear 900, the anchor portion 818 may help prevent and/or restrict the lace-receiving structure 800 from pulling back out of the upper 904 through the aperture 938.

As illustrated in FIGS. 20-26, the anchor portion 818 may extend away from the aperture 938 underneath the upper 904. The anchor portion 818 may extend at least 2 mm at least 3 mm, at least 4 mm, at least 5 mm, at least 6 mm, at least 8 mm, at least 10 mm, at least 15 mm, at least 20 mm, at least 25 mm, at least 30 mm, at most 40 mm, at most 35 mm, at most 30 mm, at most 25 mm, at most 20 mm and/or at most 15 mm away from the aperture 938 underneath the upper 904. In some such embodiments, the anchor portion 818 may extend towards the sole structure 902 (laterally when included on the lateral side of the footwear 900, and medially towards the sole structure 902 when included on the medial side of the footwear 900) and away from the tongue 924. However, in other embodiments, the anchor portion 818 may additionally or alternatively extend towards the tongue 924, the heel portion 912, and/or the front of the footwear 900. That is, the anchor portion 818 may extend longitudinally (forward and/or rearwards), laterally and/or medially.

Main body portion 816 may be configured to extend outside of the foot-receiving cavity 906, through the aperture 938, to an exterior of the footwear 900, and may be configured to further extend above and/or over the upper 904. In particular, the main body portion 816 may be configured to extend above and/or on top of the exterior surface 940 of the upper 904. Specifically, an inner side 828 of the main body portion 816 may be configured to face and/or directly contact the exterior surface 940 of the upper 904. In some examples, the distal end 834 of the main body portion 816 may be configured to extend to the throat portion 922 of the footwear 900. As one example, the main body portion 816 may be configured to extend over one or more of the throat portion 922, the tongue 924, and/or the adjustment member 928.

In some embodiments, the footwear 900 may include a reinforcing element 944 in and/or on the upper 904 that is configured to provide additional structural support for the upper 904 in the region of the upper 904 where the lace-receiving structures 800 attach to the upper 904 (e.g., where the anchor portion 818 of lace-receiving structures 800 extends underneath the exterior surface 940 of the upper). By providing this additional structural support to the upper 904, the reinforcing element 944 may help prevent the lace-receiving structures 800 from pulling through, stretching, tearing, and/or other damaging or deforming the upper 904.

In some embodiments, the reinforcing element 944 may be constructed from and/or may comprise a stiffer and/or harder material than the rest of the upper 904. For example, the upper 904 may be constructed primarily from a knit and/or woven fabric, and the reinforcing element 944 may be constructed from a plastic, rubber, and/or other suitable material for reinforcing the upper 904.

The reinforcing element 944 may be coupled to the exterior surface 940 of the upper 904 in some embodiments. In some such embodiments, the reinforcing element 944 may only cover the exterior surface 940 of the upper 904 and may not extend into the upper 904 below the exterior surface 940 of the upper. However, in other embodiments, the reinforcing element 944 may extend into and/or through the upper 904. For example, the reinforcing element 944 may be at least partially embedded in the fabric of the upper 904. Reinforcing element 944 may additionally or alternatively be coupled to and/or cover the interior surface 942 of the upper 904. In some such embodiments, the first side 842 of the anchor portion 818 may directly physically contact the reinforcing element 944. The reinforcing element 944 may be coupled to the upper 904 via adhesive, stitching, and/or thermal treatment.

In some embodiments, anchor portion 818 of the lace-receiving structure 800 may be directly coupled (e.g., via stitching and/or adhesive) to the reinforcing element 944. However, in other examples, anchor portion 818 may be directly coupled to the fabric of the upper 904 and may only be indirectly coupled to the reinforcing element 944 via the common coupling to the upper 904.

Figure 24:
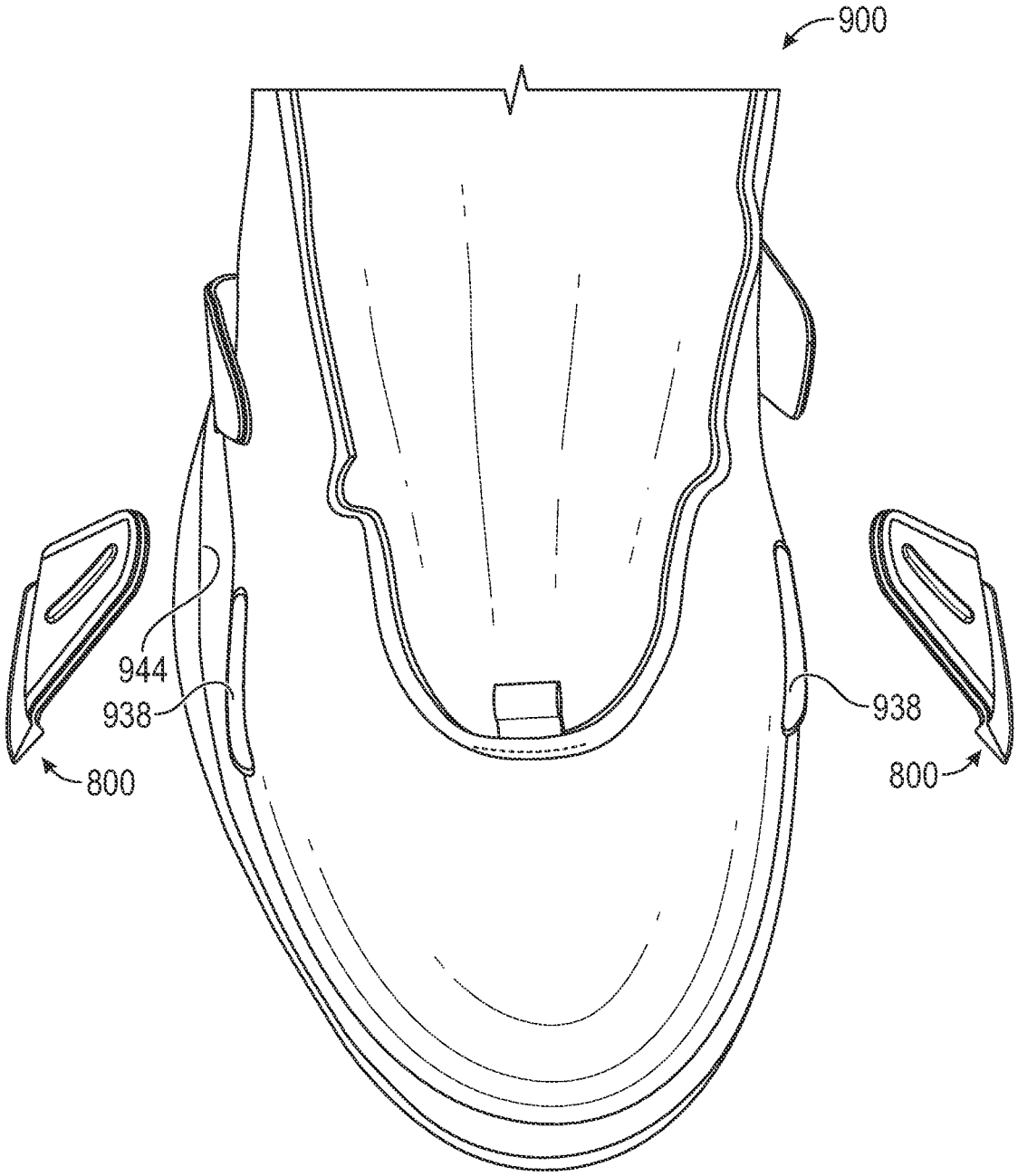
FIG. 24 is a partial exploded view of the article of footwear of FIG. 20, depicting one pair of lace-receiving structures removed from the article of footwear.

In some embodiments, the reinforcing element 944 may extend up to and/or beyond the distal end of the anchor portion 818 (e.g., the first end 846 of the anchor portion 818 when the main body portion 816 is coupled to the second end 848 of the anchor portion 818). In other embodiments, the reinforcing element 944 may only partially cover the anchor portion 818 and the anchor portion 818 may extend and/or project past the reinforcing element 944. In some embodiments, the reinforcing element 944 may at least partially surround, abut, and/or be adjacent to the aperture 938 through which the lace-receiving structure 800 is configured to extend. For example, as illustrated in FIG. 24, the reinforcing element 944 at least partially surrounds the lower portion of the aperture 938. In some embodiments, the reinforcing element 944 may extend longitudinally along the upper 904 between different lace-receiving structures that are positioned on the same side of the footwear 900. In some embodiments, the reinforcing element is configured to be positioned between the aperture 938 and the sole structure 902.

Figure 22:
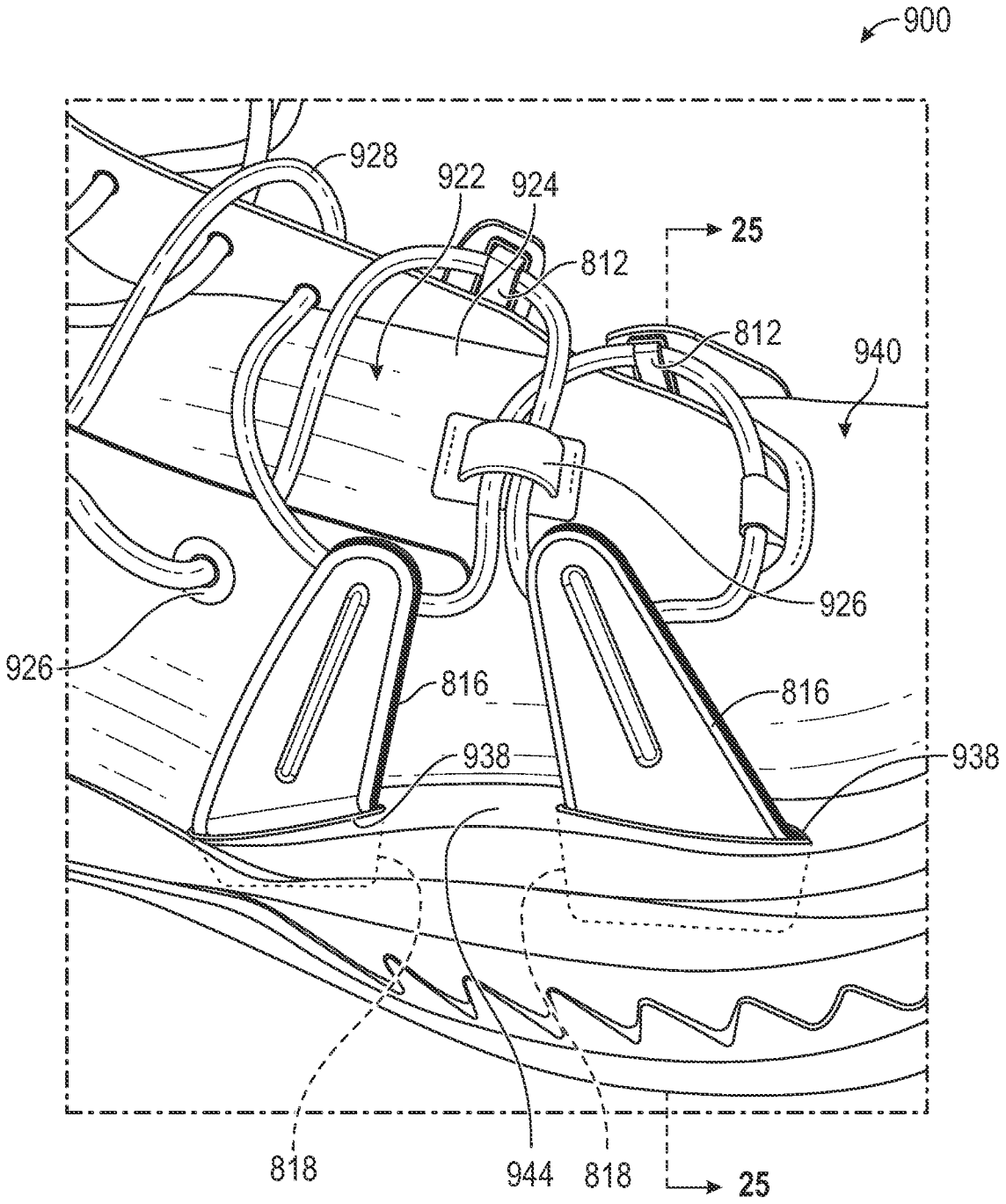
FIG. 22 is a perspective view of the article of footwear of FIG. 20.
Figure 23:
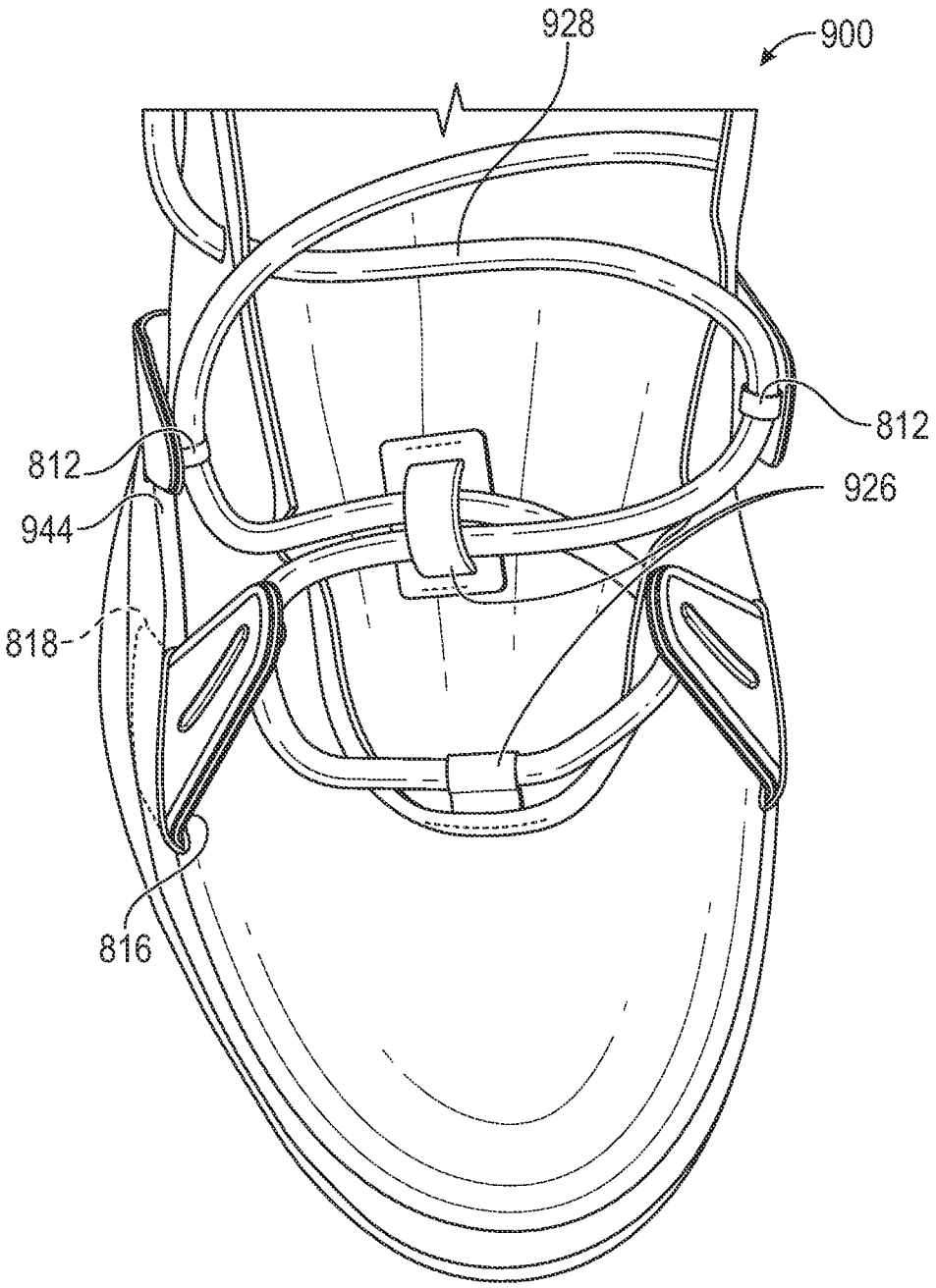
FIG. 23 is a partial top view of the article of footwear of FIG. 20.

Referring to FIGS. 25-26 they depict a cross-sectional view of the footwear 900 taken along cutting line 25-25 in FIG. 22, which extends from the lateral side 914 to the medial side 916 of the footwear 900. FIGS. 25-26 depict an example of how the lace-receiving structure 800 may bend and/or deform during the tightening process. In particular, FIG. 25 depicts the lace-receiving structures 800 in a loose configuration where the adjustment member 928 has not been threaded through a loop 820 of the eyelet 812 of each of the lace-receiving structures 800, the main body portion 816 of the lace-receiving structures 800 extends away from the upper 904 such that the distal end 834 does not directly contact the upper 904. However, FIG. 26 depicts the lace-receiving structures 800 in a tightened configuration where the adjustment member 928 extends through the eyelet 12 of each of the lace-receiving structures 800 and has been tightened by a user. As depicted, when the adjustment member 928 has been tightened by a user, the main body portion 816 may fold down, bend towards, tighten against, and/or otherwise move closer to the upper 904. Specifically, the main body portion 816 of the lace-receiving structure 800 and/or the eyelet 812 may be configured to move towards and/or tighten against the exterior surface 940 of the upper 904 as a user tightens the adjustment member 928.

Thus, the main body portion 816 may be configured to pivot relative to the upper 904. In some such embodiments, the main body portion 816 may be configured to pivot away from the upper 904 as the adjustment member 928 is loosened and/or pivot towards the upper 904 as the adjustment member is tightened.

The footwear 900 can be configured in one or more sizes (e.g., U.S. women's size 4-12) and/or widths (e.g., A, B, C, D, E, EE, and/or EEE). The footwear 900 can also be also be configured in other sizing conventions (e.g., UK, EUR, cm, etc.) and/or sizes (e.g., U.S. men's size 1-18).

Additional Examples of the Disclosed Technology

Additional examples of the disclosed technology are enumerated below.

1. An article of footwear comprising:

a sole structure;

an upper coupled to the sole structure and forming a foot-receiving cavity therebetween, wherein the upper comprises an aperture configured to receive a lace-receiving structure; and the lace-receiving structure, wherein the lace-receiving structure extends through the aperture in the upper, underneath the upper, and towards the sole structure.

2. The article of footwear of any example herein, wherein the lace-receiving structure comprises a main body portion that is configured to extend outside the foot-receiving cavity and an anchor portion that is configured to extend into the foot-receiving cavity and to couple the lace-receiving structure to the upper.

3. The article of footwear of any example herein, wherein the anchor portion covers at least a portion of an interior surface of the upper and is configured to directly contact a foot of a user.

4. The article of footwear of any example herein, wherein the anchor portion is thickest at or near where the anchor portion couples to the main body portion of the lace-receiving structure.

5. The article of footwear of any example herein, wherein the lace-receiving structure is T-shaped such that the anchor portions extend away from opposite sides of a proximal end of the main body portion.

6. The article of footwear of any example herein, further comprising an eyelet configured to receive an adjustment member therethrough.

7. The article of footwear of any example herein, wherein the eyelet is positioned on an inner surface of the main body portion.

8. The article of footwear of any example herein, wherein the eyelet is positioned at or proximate to a distal end of the main body portion.

9. The article of footwear of any example herein, wherein the eyelet is spaced away from a distal end of the main body portion by at least one eighth of the length of the main body portion.

10. The article of footwear of any example herein, wherein the main body portion directly physically contacts at least a portion of an exterior surface of the upper when the article of footwear is tied with an adjustment member.

11. The article of footwear of any example herein, wherein the main body portion is thickest at a proximal end of the main body portion.

12. The article of footwear of any example herein, wherein the lace-receiving structure comprises a stiffer material proximate where the main body portion and the anchor portion couple to one another than at a distal end of the main body portion.

13. The article of footwear of any example herein, wherein the main body portion extends through the aperture and over an/the exterior surface of the upper towards a tongue of the article of footwear.

14. The article of footwear of any example herein, wherein the anchor portion and the main body portion are at angle of at least 40 degrees and at most 120 degrees relative to one another when the article of footwear is not tightened with an adjustment member.

15. The article of footwear of any example herein, wherein the anchor portion and the main body portion form a corner where they meet.

16. The article of footwear of any example herein, wherein the lace-receiving structure is thickest at or near the corner.

17. The article of footwear of any example herein, wherein the corner is constructed from a stiffer material than the other portions of the lace-receiving structure.

18. The article of footwear of any example herein, wherein the lace-receiving structure is permanently coupled to the upper via one or more of stitches and an adhesive.

19. The article of footwear of any example herein, wherein the lace-receiving structure is removably coupled to the upper.

20. The article of footwear of any example herein, wherein the lace-receiving structure is configured to slide into and out of the foot-receiving cavity through the aperture in the upper.

21. The article of footwear of any example herein, wherein the lace-receiving structure is not stitched or adhered to the upper.

22. The article of footwear of any example herein, further comprising a reinforcing element that is coupled to the upper and is configured to provide additional structural support for the upper.

23. The article of footwear of any example herein, wherein the reinforcing element is constructed from a different, stiffer material than the upper.

24. The article of footwear of any example herein, wherein the anchor portion of the lace-receiving structure is coupled to the reinforcing element.

25. The article of footwear of any example herein, wherein the anchor portion extends underneath the reinforcing element.

26. The article of footwear of any example herein, wherein the reinforcing element extends between the aperture and the sole structure.

27. The article of footwear of any example herein, wherein the reinforcing element is positioned adjacent to the aperture.

28. The article of footwear of any example herein, wherein the reinforcing element extends longitudinally along the article of footwear from the lace-receiving structure to a second lace-receiving structure that is positioned forward or rearward of the lace-receiving structure.

29. An article of footwear comprising:

a sole structure;

an upper coupled to the sole structure and forming a foot-receiving cavity therebetween; and a lace-receiving structure coupled to the upper, wherein the lace-receiving structure comprises an anchor portion that extends into the foot-receiving cavity underneath the upper, and a main body portion that extends above the upper, over an exterior surface of the upper.

30. The article of footwear of any example herein, wherein a thickness of the main body portion monotonically decreases when progressing away from a proximal end of the main body portion towards a distal end of the main body portion.

31. The article of footwear of any example herein, wherein a width of the main body portion monotonically decreases when progressing away from a proximal end of the main body portion towards a distal end of the main body portion.

32. The article of footwear of any example herein, wherein a thickness of the anchor portion monotonically decreases when progressing away from where the anchor portion meets the main body portion.

33. The article of footwear of any example herein, a width of the anchor portion monotonically decreases when progressing away from where the anchor portion meets the main body portion.

34. The article of footwear of any example herein, wherein the main body portion is configured to extend over an exterior surface of the upper to a throat of the footwear.

35. The article of footwear of any example herein, wherein the lace-receiving structure is coupled to the upper at a forefoot portion of the article of footwear.

36. The article of footwear of any example herein, where the anchor portion extends from the main body portion towards the sole structure and away from the throat portion of the article of footwear.

37. An article of footwear comprising:

a sole structure;

an upper coupled to the sole structure and forming a foot-receiving cavity therebetween, wherein the upper comprises an aperture that is configured to receive a lace-receiving structure;

a reinforcing element coupled to the upper; and the lace-receiving structure, wherein the lace-receiving structure extends through the aperture into the foot-receiving cavity of the article of footwear and is coupled to the reinforcing element.

38. The article of footwear of any example herein, wherein the reinforcing element comprises a different material than the upper.

39. The article of footwear of any example herein, wherein the reinforcing element is coupled to an exterior surface of the upper.

40. The article of footwear of any example herein, wherein the reinforcing element is embedded in the upper.

41. The article of footwear of any example herein, wherein the reinforcing element is positioned between the aperture and the sole structure.

42. The article of footwear of any example herein, wherein the reinforcing element at least partially surrounds the aperture.

43. The article of footwear of any example herein, wherein the anchor portion of the article of footwear extends underneath the reinforcing element.

It should be noted that in any of the examples disclosed herein, a lace-receiving structure can be coupled to the article of footwear prior to the point of sale to the end user (such as in examples where the lace-receiving structure is permanently coupled to the article of footwear) or after the point of sale to the end user (such as in examples where the lace-receiving structure is removably coupled to the article of footwear). For example, a wearer can purchase an article of footwear with the lace-receiving structure already attached and/or can purchase the article of footwear without the lace-receiving structure attached and can attach it themselves after purchase. Further, in examples, where the lace-receiving structure is removably coupled to the article of footwear, a user may replace the lace-receiving structure with different lace-receiving structures as desired.

Any feature(s) of any example(s) disclosed herein can be combined with or isolated from any feature(s) of any example(s) disclosed herein, unless otherwise stated. For example, any one of the lace-receiving structures disclosed herein (e.g., the lace-receiving structures 10 and 800) can be used with the article of footwear 900. As another example, an article of footwear can comprise one or more lace-receiving structures 10 and one or more lace-receiving structures 800.

Further, it should be appreciated that the lace-receiving structures illustrated in FIGS. 1-26 may comprise different geometries (sizes, shapes, thickness, widths, lengths, relative sizing and/or positioning of components, etc.) than those shown in the FIGS. 1-26. For example, although the anchor and main body portions are illustrated as being rectangular prisms in FIGS. 1-13, it should be appreciated that the main body and anchor portions may comprise other shapes, profiles, sizes, etc. As just one such example, the anchor portions may comprise only one projection, such as is illustrated in FIGS. 14-26, and/or may comprise multiple projections, such as is illustrated in FIGS. 1-6, 9-10, and 13. As another such example, the main body and/or anchor portions may be tapered, such as is illustrated in FIGS. 14-26. As yet another such example, the anchor portion and main body portion may attach to one another at different locations on the anchor portion and/or the main body portion than those illustrated in FIGS. 1-26.

In view of the many possible embodiments to which the principles of the disclosure may be applied, it should be recognized that the illustrated embodiments are only examples and should not be taken as limiting the scope of the disclosure.

The invention claimed is:

1. An article of footwear comprising:

a sole structure;

an upper coupled to the sole structure and forming a foot-receiving cavity therebetween, wherein the upper comprises a throat and an aperture configured to receive a lace-receiving structure;

an adjustment member;

the lace-receiving structure, wherein the lace-receiving structure comprises an anchor portion and extends through the aperture in the upper, underneath the upper, and towards the sole structure, wherein the anchor portion has a first side and a second side disposed at an angle to the first side forming a wedge; and a reinforcing element that is coupled to the upper and offset from the throat towards the sole structure, wherein the first side of the anchor portion abuts the reinforcing element, faces an interior surface of the upper, and is decoupled from the sole structure when the adjustment member is in a first, tightened configuration, and wherein the entire anchor portion is spaced from the reinforcing element and the interior surface of the upper and is decoupled from the sole structure when the adjustment member is in a second, loosened configuration.

2. The article of footwear of claim 1, wherein the lace-receiving structure comprises a main body portion that is configured to extend outside the foot-receiving cavity and the anchor portion is configured to extend into the foot-receiving cavity to couple the lace-receiving structure to the upper.

3. The article of footwear of claim 2, wherein the anchor portion covers at least a portion of the interior surface of the upper and is configured to directly contact a foot of a user.

4. The article of footwear of claim 2, wherein the anchor portion is thickest at or near where the anchor portion couples to the main body portion of the lace-receiving structure.

5. The article of footwear of claim 2, further comprising an eyelet configured to receive the adjustment member therethrough.

6. The article of footwear of claim 2, wherein the lace-receiving structure comprises a stiffer material proximate where the main body portion and the anchor portion couple to one another than at a distal end of the main body portion.

7. The article of footwear of claim 1, wherein the lace-receiving structure is removably coupled to the upper, and wherein the lace-receiving structure is configured to slide into and out of the foot-receiving cavity through the aperture in the upper.

8. The article of footwear of claim 1, wherein the reinforcing element is constructed from a different, harder material than the upper such that the anchor portion cannot pull through the aperture.

9. The article of footwear of claim 1, wherein the anchor portion of the lace-receiving structure is attached to the reinforcing element, and wherein the anchor portion extends underneath the reinforcing element.

10. The article of footwear of claim 1, wherein the reinforcing element is positioned adjacent to the aperture.

11. An article of footwear comprising:

a sole structure;

an upper coupled to the sole structure and forming a foot-receiving cavity therebetween; and a lace-receiving structure removable relative to the upper and the sole structure, wherein the lace-receiving structure comprises an anchor portion that extends into the foot-receiving cavity underneath the upper, and a main body portion that extends above the upper, over an exterior surface of the upper, wherein the anchor portion has a first end, a second end, and opposing first and second sides extending between the first and second ends, and the main body portion has a distal end, a proximal end, and a lower surface extending between the distal and proximal ends, wherein the first side of the anchor portion faces an interior surface of the upper;

wherein the first end of the anchor portion is coupled to the proximal end of the main body portion and the second side of the anchor portion meets the lower surface of the main body portion at a non-zero angle to form a corner, and wherein a thickness of the anchor portion decreases when progressing away from the corner and a thickness of the main body portion decreases when progressing away from the corner.

12. The article of footwear of claim 11, wherein the thickness and a width of the main body portion monotonically decreases when progressing away from the proximal end of the main body portion towards the distal end of the main body portion.

13. The article of footwear of claim 11, wherein the thickness of the anchor portion monotonically decreases when progressing away from the corner.

14. The article of footwear of claim 11, where the anchor portion extends from the main body portion towards the sole structure and away from a/the throat portion of the article of footwear.

15. An article of footwear comprising:

a sole structure;

an upper coupled to the sole structure and forming a foot-receiving cavity therebetween, wherein the upper comprises an aperture that is configured to receive a lace-receiving structure;

a reinforcing element coupled to the upper; and the lace-receiving structure, wherein the lace-receiving structure is decoupled from the sole structure and comprises an anchor portion and a main body portion, wherein the lace-receiving structure extends through the aperture into the foot-receiving cavity of the article of footwear and abuts the reinforcing element, and wherein the anchor portion comprises a first end, a second end, and opposing first and second sides extending between the first and second ends, wherein the opposing first and second sides are disposed at an angle to each other forming a wedge, and the main body portion comprises a distal end, a proximal end, and a lower surface extending between the distal and proximal ends, wherein the first end of the anchor portion is coupled to the proximal end of the main body portion and the second side of the anchor portion extends from the lower surface of the main body portion at a non-zero angle forming a corner, and and the first side of the anchor portion presses against an interior surface of the upper and the reinforcing element when the lace-receiving structure is under tension to prevent the lace-receiving structure from pulling out of the foot-receiving cavity through the aperture.

16. The article of footwear of claim 15, wherein the reinforcing element comprises a different material than the upper.

17. The article of footwear of claim 15, wherein the reinforcing element is coupled to an exterior surface of the upper.

18. The article of footwear of claim 15, wherein the reinforcing element is embedded in the upper.

19. The article of footwear of claim 15, wherein the anchor portion is removably coupled to the reinforcing element.

* * * * *